US008985756B2

(12) United States Patent
Boland et al.

(10) Patent No.: US 8,985,756 B2
(45) Date of Patent: Mar. 24, 2015

(54) DYNAMIC DRYER CONTROL IN PRINTING

(75) Inventors: Stuart J. Boland, Denver, CO (US); Larry M. Ernst, Longmont, CO (US); Scott Johnson, Erie, CO (US); Casey E. Walker, Boulder, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 212 days.

(21) Appl. No.: 13/468,460

(22) Filed: May 10, 2012

(65) Prior Publication Data

US 2012/0287196 A1 Nov. 15, 2012

Related U.S. Application Data

(60) Provisional application No. 61/485,041, filed on May 11, 2011.

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
CPC ..... B41J 11/002; B41J 11/0015; B41M 7/00; B41M 7/0072; B41M 7/0081; B41M 7/009
USPC ..... 347/102, 101; 34/90
See application file for complete search history.

(56) References Cited

U.S. PATENT DOCUMENTS

| | | | | |
|---|---|---|---|---|
| 4,813,153 | A * | 3/1989 | Palmer et al. | 34/550 |
| 5,212,498 | A * | 5/1993 | Sugimori | 346/25 |
| 5,214,442 | A | 5/1993 | Roller | |
| 5,349,905 | A | 9/1994 | Taylor et al. | |
| 5,436,710 | A * | 7/1995 | Uchiyama | 399/336 |
| 5,714,990 | A | 2/1998 | Courtney | |
| 5,784,090 | A * | 7/1998 | Selensky et al. | 347/102 |
| 6,508,552 | B1 * | 1/2003 | Steinfield et al. | 347/102 |
| 6,511,147 | B2 * | 1/2003 | Kubota et al. | 347/16 |
| 6,523,948 | B2 * | 2/2003 | Matsumoto et al. | 347/102 |
| 6,973,874 | B2 | 12/2005 | DeMoore et al. | |

(Continued)

FOREIGN PATENT DOCUMENTS

| | | |
|---|---|---|
| DE | 102010001079 | 7/2010 |
| EP | 2258553 | 12/2012 |

(Continued)

*Primary Examiner* — Alessandro V. Amari
*Assistant Examiner* — Jeremy Bishop
(74) *Attorney, Agent, or Firm* — Duft Bornsen & Fettig LLP

(57) ABSTRACT

Embodiments described herein provide variable heat control for a printer. One system includes a dryer operable to dry ink applied to a print medium. The system also includes a controller communicatively coupled to the dryer and operable to filter a bitmap to provide variable heat control from the dryer to the applied ink according to the bitmap to attach the ink to the print medium. The print medium may be a continuous form print medium. In this regard, the controller maybe operable to determine a speed at which the continuous form print medium is moving, to generate a heat control signal operable to provide the variable heat control, and to delay transmission of the heat control signal based on the determined speed of the continuous form print medium until the ink applied to the continuous form print medium is within range of the dryer.

18 Claims, 7 Drawing Sheets

(56) References Cited

U.S. PATENT DOCUMENTS

| | | | | |
|---|---|---|---|---|
| 7,137,694 | B2 | 11/2006 | Ferran et al. | |
| 7,433,627 | B2 * | 10/2008 | German et al. | 399/102 |
| 7,440,722 | B2 * | 10/2008 | Lofthus et al. | 399/328 |
| 7,517,075 | B2 | 4/2009 | Smith et al. | |
| 7,520,586 | B2 * | 4/2009 | Itoh | 347/19 |
| 7,672,634 | B2 * | 3/2010 | Lofthus et al. | 399/341 |
| 7,913,622 | B2 * | 3/2011 | Pitz et al. | 101/487 |
| 7,934,824 | B2 * | 5/2011 | Nishida | 347/102 |
| 7,988,253 | B2 * | 8/2011 | Komamiya et al. | 347/19 |
| 8,220,391 | B2 * | 7/2012 | Hirokawa et al. | 101/488 |
| 8,313,188 | B2 * | 11/2012 | Muro et al. | 347/102 |
| 8,382,273 | B2 * | 2/2013 | Houjou | 347/102 |
| 8,382,274 | B2 * | 2/2013 | Mitsuzawa | 347/102 |
| 8,596,777 | B2 * | 12/2013 | Okamoto | 347/102 |
| 2001/0052920 | A1 | 12/2001 | Matsumoto et al. | |
| 2004/0085423 | A1 * | 5/2004 | Bronstein et al. | 347/102 |
| 2005/0235851 | A1 * | 10/2005 | Beier et al. | 101/424.1 |
| 2006/0070256 | A1 * | 4/2006 | Weissman et al. | 34/225 |
| 2006/0250434 | A1 | 11/2006 | Smith et al. | |
| 2009/0165329 | A1 | 7/2009 | Reichelsheimer et al. | |
| 2009/0184987 | A1 * | 7/2009 | Shinkawa | 347/1 |
| 2009/0266258 | A1 | 10/2009 | Reichelsheimer et al. | |
| 2010/0154244 | A1 | 6/2010 | Kuta et al. | |

FOREIGN PATENT DOCUMENTS

| | | |
|---|---|---|
| JP | 2039940 | 2/1990 |
| JP | 2004249473 | 9/2004 |
| WO | WO2006043269 | 4/2006 |

* cited by examiner

DYNAMIC DRYER CONTROL IN PRINTING

CROSS-REFERENCE TO RELATED APPLICATIONS

This patent application claims priority to and thus the benefit of an earlier filing date from U.S. Provisional Patent Application No. 61/485,041 (filed May 11, 2011), the entire contents of which are incorporated by reference.

FIELD OF THE INVENTION

The invention relates generally to the field of print dryers and, in particular, to variable heat control of these dryers during printing.

BACKGROUND

In color printing, a printer prints input data onto a print medium, such as paper. A CMYK printer, for example, represents bitmap data with various levels of cyan (C), magenta (M), yellow (Y), and black (K) ink. Each of these inks has a unique chemical makeup and fluid content (e.g., carrier fluids including water) that result in differing drying characteristics. In other words, some ink combinations contain more fluid than other ink combinations and therefore require additional drying to attach the ink particles to the print medium.

Printer systems are typically configured with heaters or dryers that are used to evaporate the fluid content of the ink such that the ink attaches to the print medium. In production printing systems, these dryers have multiple elements that radiate heat to a continuous form print medium, or "web", so as to dry the ink onto the print medium after the print engine applies the ink to the print medium. To accommodate the different drying characteristics of inks, the heating elements are generally configured to radiate a uniform heat that is established based on the area of the substrate that contains the highest concentration of ink. Thus, by ensuring that the highest concentration of ink is dried on the print medium, all inks are virtually assured of being attached to the print medium. Generally, a portion of the radiant heat energy from the print dryer is absorbed into the dryer's structural members and shields. Certain print dryers, such as infrared dryers, also use an exhaust system to remove the evaporated carrier fluid as well as the absorbed heat from the immediate environment.

In any case, the uniform application of heat to the print medium results in the unnecessary consumption of energy since not all applications of ink require the same amount of heat for evaporation of the carrier fluids. This results in more expensive printing operations, particularly in the case of high-speed production printing systems. Moreover, the excessive application of heat to certain parts of the print medium results in a potential fire hazard. For example, areas of the print medium with lower concentrations of ink sometimes dry faster, causing the print medium to be overheated. And, in some instances, paper dust from the print medium propagates through the dryer and catches fire.

SUMMARY

Embodiments described herein provide dynamic dryer control for a printer. In one embodiment, a dryer system includes a dryer operable to dry ink applied to a print medium. The system also includes a controller communicatively coupled to the dryer and operable to filter a bitmap to provide variable heat control of the dryer and vary the heat from the dryer to the applied ink according to the bitmap to attach the ink to the print medium. For example, the controller may filter a bitmap to identify image regions in the bitmap, determine a level of heat control for each of the identified image regions in the bitmap, locate the image regions represented on the print medium with ink applied to the print medium, and independently apply heat to each of the image regions of applied ink based on the determined levels of heat control.

The print medium may be a continuous form print medium. In this regard, the controller (e.g., a feed-forward controller) is further operable to determine a speed at which the continuous form print medium is moving, to generate a heat control signal operable to provide the variable heat control of the dryer, and to delay transmission of the heat control signal based on the determined speed of the continuous form print medium until the ink applied to the continuous form print medium is within range of the dryer.

Generally, the dryer is a radiant heat dryer, such as an infrared dryer that includes a plurality of heating elements. In this regard, the controller is further operable to filter the bitmap to identify average image regions in the bitmap, and to generate heat control signals based on the identified average image regions for application to the heating elements to provide the variable heat. For example, the controller may process the bitmap through a probability distribution function to generate time varying heat control signals for the heating elements across the web, thereby providing time/spatial varying heat control of the dryer.

The controller may be further operable to determine a color density for a portion of the print medium based on the identified average image regions, and to generate a heat control signal for each heating element that corresponds to the color density for the portion of the print medium. The controller may be further operable to generate the heat control signal for each heating element based on a lookup table that maps color density values to drying temperature. The controller may be further operable to filter the identified average image regions via an inverse response of the dryer to provide heating from the dryer that is independent of ink volume changes. The controller may be further operable to serialize image data of the bitmap to expedite generation of heat control signals used to vary the heat from the dryer. The controller may be further operable to filter another bitmap to generate a heat control signal for use by the dryer to dry the applied ink according to the other bitmap. The controller may be also operable to provide the variable heat control of the dryer based on a color of the ink applied to the print medium and/or based on absorption of the print medium.

The various embodiments disclosed herein may be implemented in a variety of ways as a matter of design choice. For example, the embodiments may take the form of physical machines, computer hardware, software, firmware, or combinations thereof. In another embodiment, a computer readable medium is operable to store software instructions for converting the input data to the color space of the printer. These software instructions are configured so as to direct the processor or some other processing system to operate in the manner described above. Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
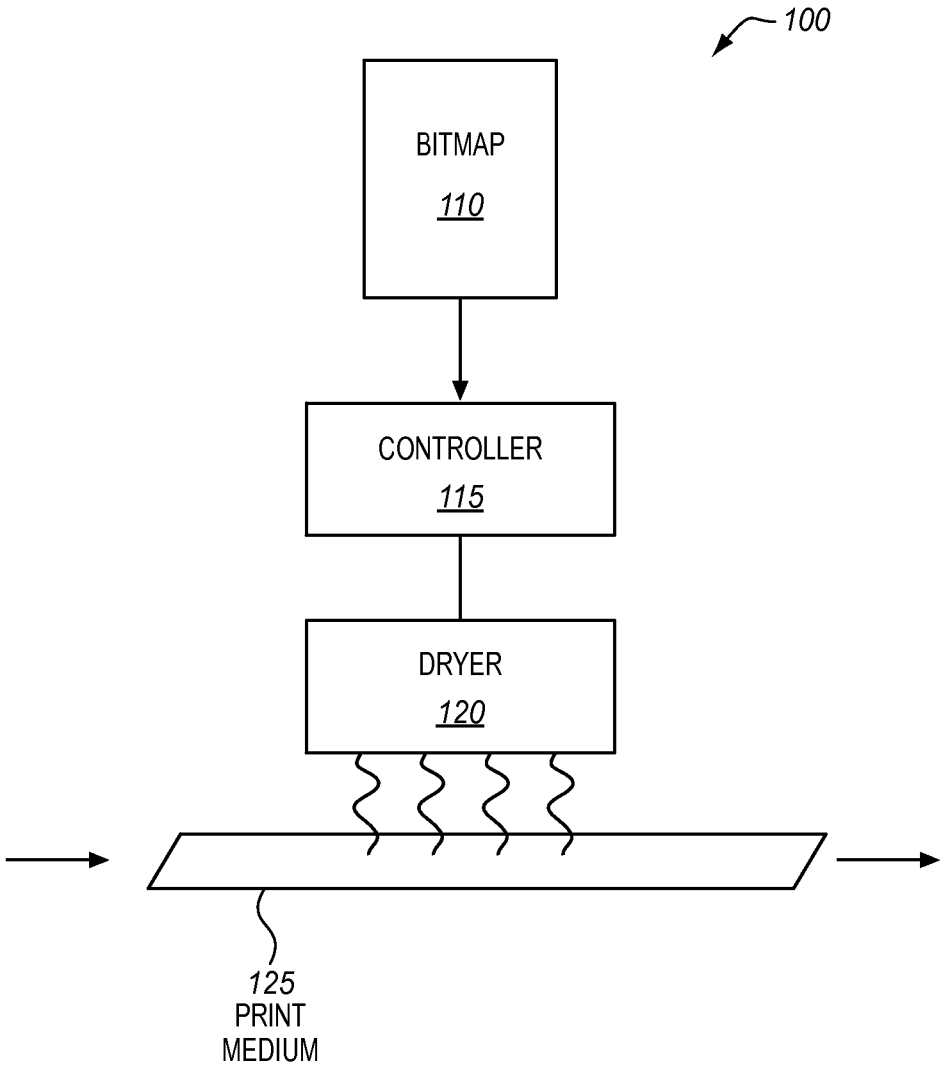
FIG. 1 is a block diagram of a dryer system in an exemplary embodiment.

FIG. 1 is a block diagram of a dryer system 100 in an exemplary embodiment. The dryer system 100 includes a controller 115 and a dryer 120. The dryer system 100 is operable to provide variable heat so as to dry ink that is applied to a print medium 125. The dryer system 100 processes a bitmap 110 to determine different levels of heat to apply to the print medium 125 so as to correspondingly evaporate inks on the print medium 125 having different concentrations of ink. The controller 115 may be configured in a variety of ways as a matter of design choice. For example, the controller 115 may be configured as a general-purpose computer processor that executes software instructions to process the bitmap 110 and generate heat control signals that are operable to control the dryer 120. Alternatively, the controller 115 may be implemented as an analog system with a feedback control.

Printing system dryers, such as the dryer 120, exist in many forms. Some high-speed production printing systems use ultraviolet dryers that radiate ultraviolet light to attach special ultraviolet sensitive inks applied to the print medium. Others may use an infrared heater or other radiant heater that includes a plurality of heating elements, each of which radiates heat to the print medium 125 to evaporate the carrier fluids and/or other liquids in the ink applied. In any case, the dryer 120 is communicatively coupled to the controller 115 such that the controller 115 may independently control the heating elements of the dryer 120 to provide a variable heat control to the print medium 125 based on the bitmap 110.

The dryer system 100 is operable with a variety of printers. For example, the dryer system 100 may be configured with a high-speed production printing system that is operable to print large volumes of information, such as newspapers, enterprise payrolls, etc. In this regard, the print medium 125 may be a continuous form print medium, or "web". The bitmap 110 is generally a grid of pixels, or "pels", of varying color values used to form an image. When used in printing, the bitmap 110 directs the print engine to mark the print medium 125 with ink or toner to physically display the image of the bitmap 110 on the print medium 125. Thus, the ink applied to the print medium 125 is a physical representation of the data contained in the bitmap 110.

Figure 2:
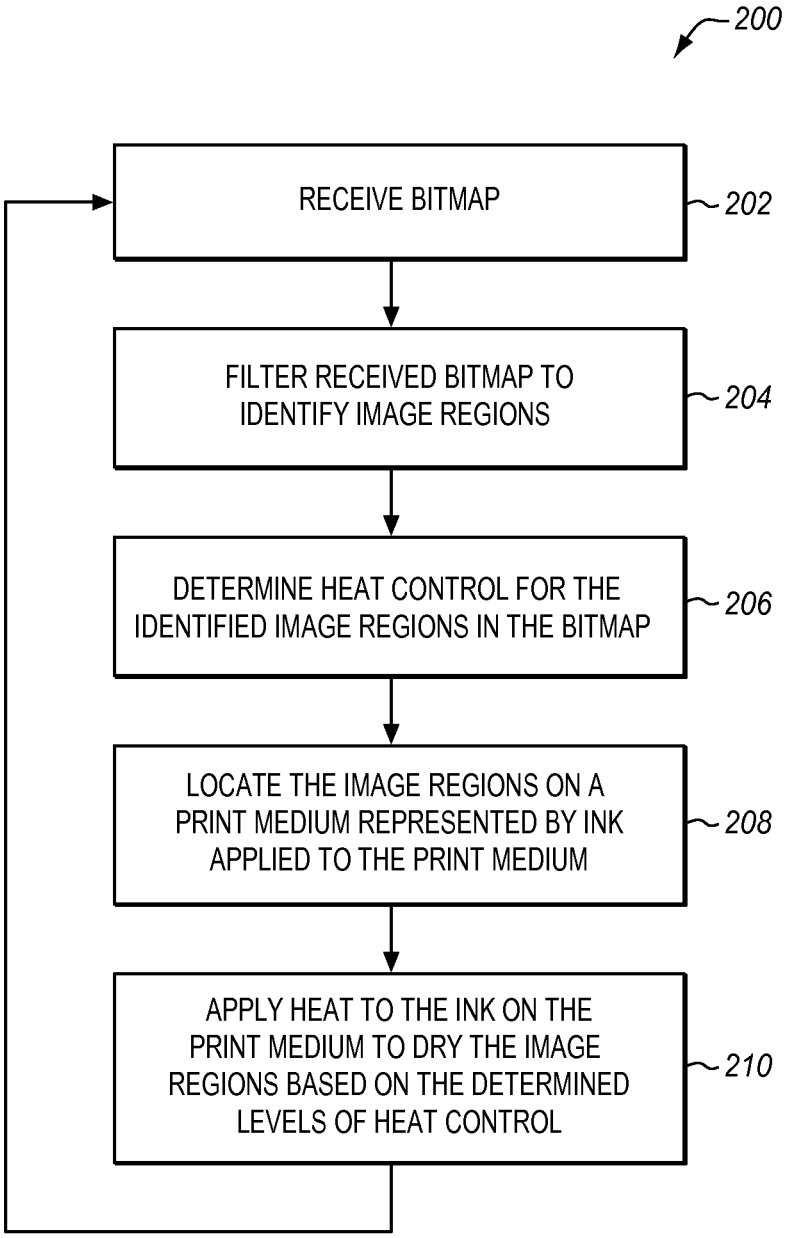
FIG. 2 is a flowchart of a process for drying ink applied to a tangible medium in an exemplary embodiment.

The particular operations of the dryer system 100 are now discussed with respect to flow chart 200 of FIG. 2. More specifically, the flow chart 200 illustrates a process for dynamically drying ink applied to the print medium 125 in an exemplary embodiment. The dryer system 100 initiates when the controller 115 receives the bitmap 110, in the process element 202. Thereafter, the controller 115 initiates processing of the bitmap 110, in the process element 204, by filtering the bitmap 110 to identify various regions therein. For example, the bitmap 110 may comprise a variety of colors arranged to convey an image. Each color in the image may represent a different concentration of ink due to a particular ink or combination of inks being applied to the print medium 125. However, certain regions of ink concentration may be identified by filtering the bitmap 110. In this regard, the controller 115 may filter the bitmap 110 by averaging the color values therein to identify image regions which, when applied to the print medium 125, may have higher ink concentrations than other image regions. Based on these identified image regions, the controller 115 may determine various levels of heat control for the identified image regions, in the process element 206, such that the dryer 120 may dry the identified image regions accordingly. Then, the controller 115 may locate the image regions on the print medium 125 that are represented by the applied ink, in the process element 208. That is, the controller 115 may use the identified image regions of the bitmap 110 to locate those image regions on the print medium 125 as the print medium 125 passes by the dryer 120 after the ink has been applied to the print medium 125. The dryer 120 may then apply heat to the print medium 125 to dry the image regions based on the determined levels of heat control for the identified image regions, in the process element 210. For example, the controller 115 may apply heat control signals to corresponding heating elements to independently heat the identified image regions on the print medium 125.

Figure 3:
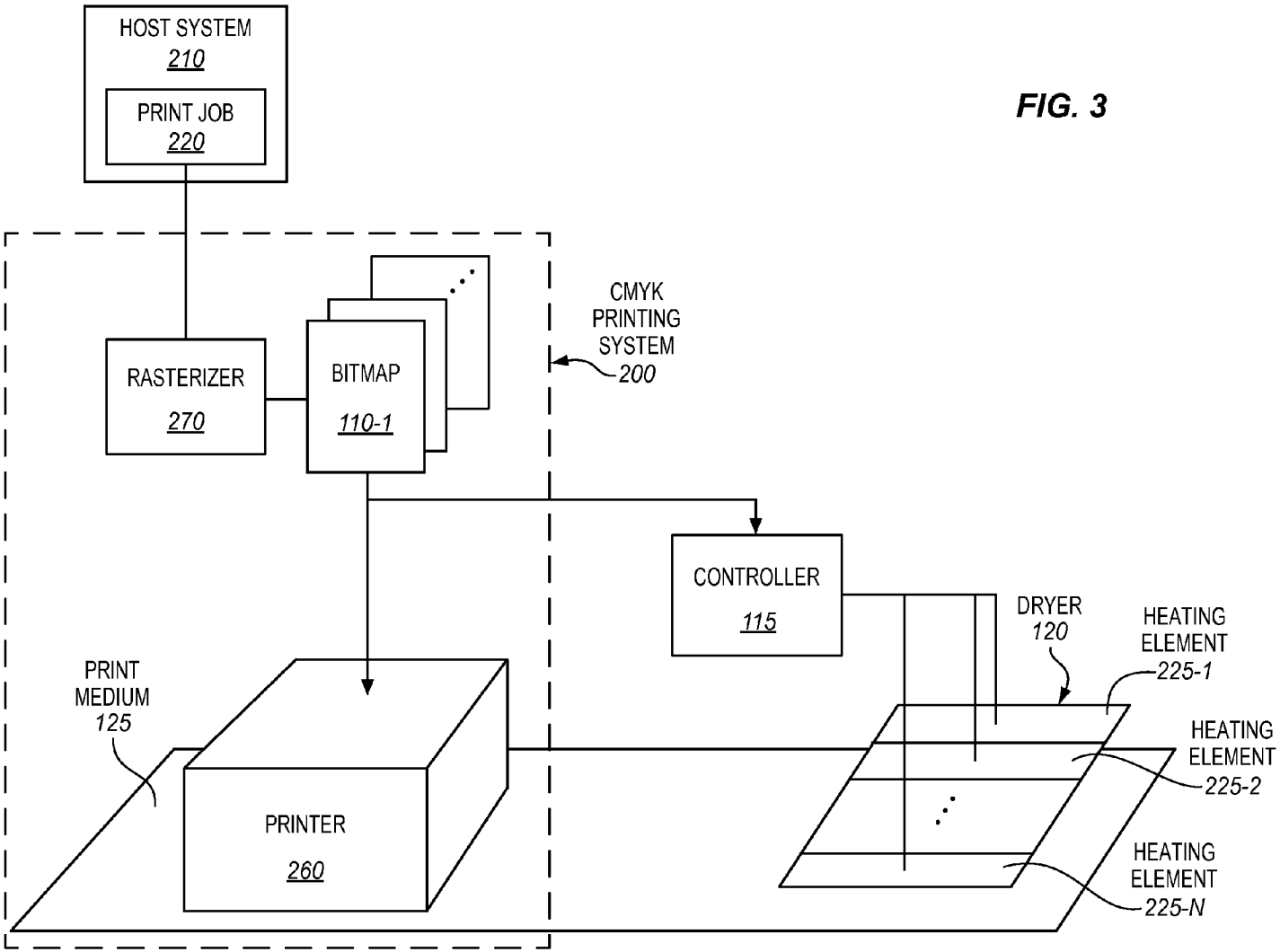
FIG. 3 is a block diagram of a printer system using the dryer system of FIG. 1 in an exemplary embodiment.

FIG. 3 is a block diagram of a printing system 200 using the dryer system 100 of FIG. 1 in an exemplary embodiment. In this embodiment, the printing system 200 is a CMYK inkjet printing system operable to mark the print medium 125 with various concentrations of cyan (C), magenta (M), yellow (Y), and black (K) inks via the printer 260. A host system 210 is in communication with the printing system 200 to print a print job 120 onto a print medium 125 via the printer 260. The resulting print medium 125 may be printed in color and/or in any of a number of gray shades, including black and white. The host system 110 may comprise any computing device, such as a personal computer or a server that is operable to prepare the print job 220 for printing via the printer 260. The print job 220 may be any file or data that describes how the input data prints on the print medium 125. For example, the print job 120 may include PostScript data, Printer Command Language ("PCL") data, and/or any other page description language. The printing system 200 may be capable of printing relatively high volumes (e.g., greater than 100 pages per minute). The print medium 125 may be continuous form paper, cut sheet paper, and/or any other medium suitable for printing. The printing system 200, in one generalized form, includes the printer 260 that presents a bitmap 110 onto the print medium 125 based on the print job 220. That is, the printing system 200 may rasterize the data of the print job 220 via the rasterizer 270 to generate one or more bitmaps 110-1-N (where N is simply intended to represent an integer greater than 1 and not necessarily equal to other N references herein) for presentation to the printer 260 such that the printer 260 may apply ink onto the print medium 125 that is representative of the bitmaps 110. Alternatively, the bitmaps 110 may be rasterized by the host system 210 and transferred to the CMYK printing system 200.

As the bitmaps 110-1-N are transferred to the printer 260 for printing onto the print medium 125, the bitmaps 110-1-N are also transferred to the controller 115 for processing as described above. More specifically, the controller 115 filters each bitmap 110 to provide variable heat control to the dryer 120. As mentioned, the dryer 120 may include a plurality of heating elements 225-1-N that are used to evaporate the carrier fluids and/or other liquids from the ink such that the colors of the ink attach to the print medium 125. In this regard, the controller 115 may generate a plurality of heat control signals each of which being configured to independently control the heating elements 225-1-N of the dryer 120. That is, the controller 115 may generate a control signal for each of the heating elements 225-1-N to independently control heat radiating from the heating elements 225-1-N to the print medium 125. Accordingly, each of the heating elements 225-1-N is operable to radiate heat to a region of the print medium 125 that differs from that of other heating elements 225 of the dryer 120. Moreover, the heat control signals themselves may vary over time to change the radiated heat from a particular heating element 225 over time. Thus, a controller 115 is operable to provide temporal and spatial heat control of the dryer 120 based on a particular bitmap 110 that it receives. Although shown and described with respect to a CMYK printer, the invention is not intended to be so limited. For example, the dryer system 100 may be operable with other types of printers, such as monochrome printers, so as to identify image regions within the bitmaps 110 and dry them as described above.

Figure 4:
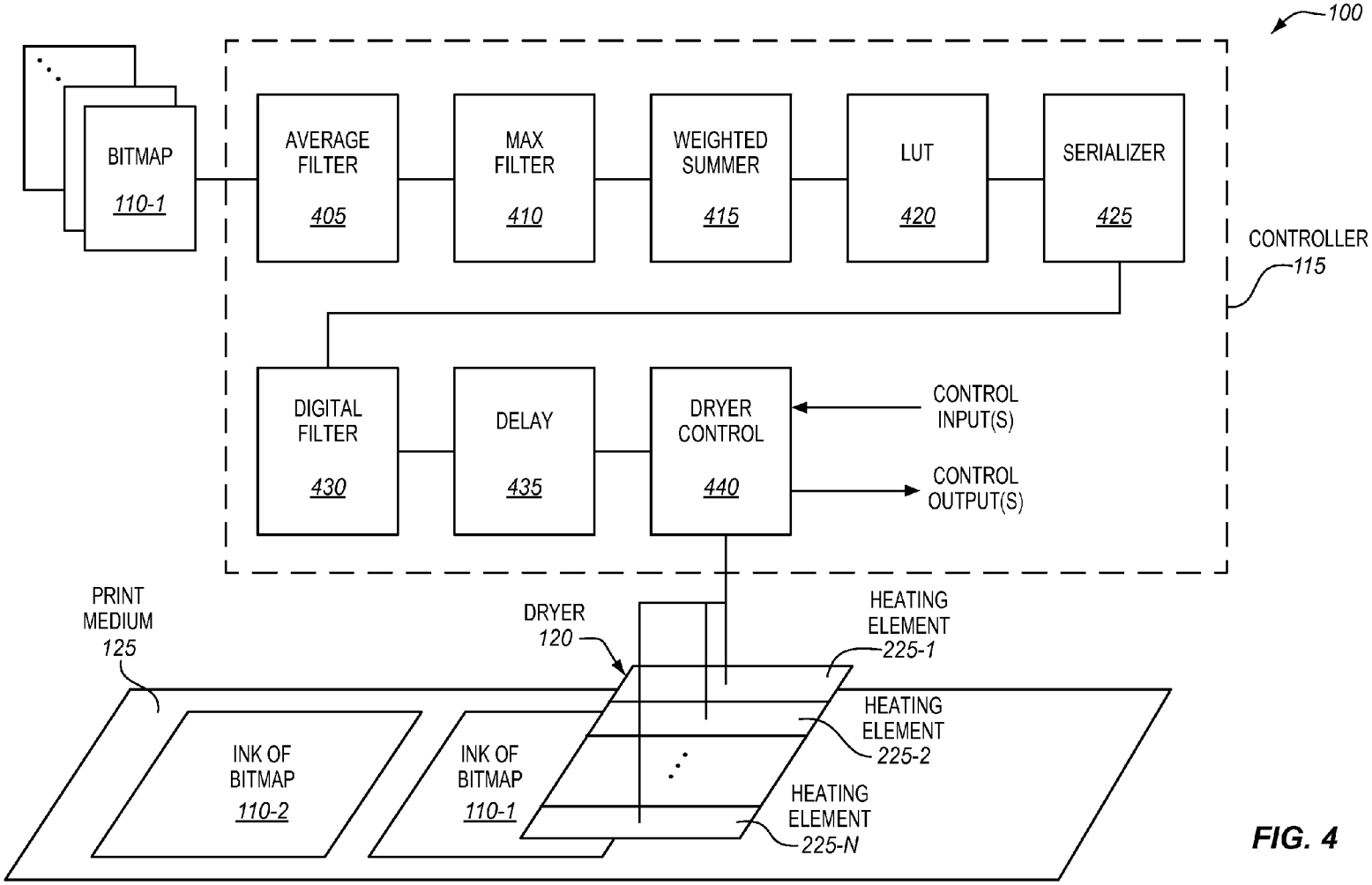
FIG. 4 is a detailed block diagram of a dryer system in an exemplary embodiment.

FIG. 4 is a detailed block diagram of the dryer system 100 in an exemplary embodiment. In this embodiment, the controller 115 is configured as a feed forward control system operable to generate heat control signals on a bitmap by bitmap basis. A feed-forward control system is operable to provide a control signal based on an external source, such as the bitmaps 110-1-N. In other words, a controller 115 receives a first bitmap 110-1 to generate heat control signals for application to the heating elements 225-1-N of the dryer 120. The heating elements 225-1-N use the heat control signals to dry the ink applied to the print medium 125 that is representative of the bitmap 110-1. That is, the heating elements 225-1-N respond to the heat control signals to apply time variable radiant heat. Afterwards, the controller may receive and process a second bitmap 110-2 to generate heat control signals for application to the heating elements 225-1-N to dry the applied ink that is representative of the bitmap 110-2. The controller 115 then processes a third bitmap 110-3 in similar fashion, and so on.

In this embodiment, the dryer 120 uses infrared energy to dry the print medium 125. An infrared radiant dryer uses one or more infrared energy sources (e.g., heating elements 225-1-N). The infrared spectrum determines where the infrared energy is absorbed into the print medium 125 and the inks used thereon. Attachment of the ink's pigment to the print medium 125 occurs when the infrared energy absorbed into the ink evaporates the water and/or other carrier fluids of the ink after the ink is applied to the print medium 125.

The spectrum of the infrared energy can be chosen such that the carrier fluids absorb radiant energy based on the ink absorption spectrum. The substrate properties of the print medium 125 tend to limit the amount of energy absorbed. Some inks may even be configured to increase the energy absorption within the print medium 125. Thus, from a simplified ink model, the amount of energy to dry the combination of the substrate of the print medium 125 and ink is generally a function of the ink volume applied, spectral characteristics of each primary color (e.g., C, M, Y, and K), and the spectral characteristics of the print medium 125, including reflectance and transmittance.

To achieve optimal control of the dryer 120, the function defined in the amount of energy is first modeled. Because of the numerous interactions, one approach is to use theoretical models that define a class of functions for the model. The model is then fit to actual empirical data. Orthogonal functions tend to minimize interaction effects of the drying process. These functions mainly fall into categories known as radial basis functions (e.g., Gaussian, Polyharmonic spline, etc.) and continuous cumulative probability functions (e.g., Weibull distribution, love normal distribution, etc.). The continuous cumulative probability function is an appropriate choice because drying becomes a matter of whether the probability that the amount of ink carrier fluid removed when the dryer 120 control inputs are applied is within a certain range. If the probability is within the expected range, the correct dryer inputs are applied. Because the continuous cumulative probability function is a multidimensional function, the relationship between the carrier fluid remaining on the substrate of the print medium 125 versus the amount of ink applied to the substrate of the print medium 125 for various inputs to the dryer 120 may be defined by holding the probability constant. Then, the correct model can be developed based on a set of empirical data describing the performance of the dryer 120.

The dryer 120 is controlled based in part on derived inputs of the printer 260. For a practical dryer, it is assumed that the infrared source is subdivided from 1 to N effective energy sources, or heating elements 225. Each of the heating elements 2251-N is arranged to produce uniform output across the web within the tolerance limits for a constant input. Then, the ink volume applied to the substrate of the print medium 125 prior to drying can be estimated.

Because ink from an inkjet head of the printer 260 is generally a constant volume device for each of its output dropped sizes, the bitmap for each color plane halftone image defines which drops size is applied at each addressable location. By replacing the digital representation of the drops by the physical drop size ink volume, a heat control signal at each pel location for the bitmap 110 can be defined. As mentioned, the dryer 120 is subdivided into N energy sources, where each subdivided energy source radiates a fixed area, and the radiated area is uniform across the web at each boundary between the heating elements 225. Accordingly, the average amount of energy across the web for each subdivided heating element 225 is assumed to be proportional to the total ink volume across the effective length of the subdivided energy source of the dryer 120 for a single pel row of the bitmap 110. In other words, the process direction of the print medium 125 width is a reciprocal of the process direction resolution.

For the static case, the issue of drying is proportional to the total ink volume in the radiated area. In the dynamic case, however, the ink volume changes based on the print job even though the velocity of the print medium 125 is approximately constant. Accordingly, the dryer control 440 may also use control inputs that take into account the dynamic response of the dryer 120 to change the output power level. The input signal driving the dryer 120 is modified by the inverse response to the dryer 120 to ensure that the energy of the dryer 120 output is relatively independent of the dynamic ink volume changes. The response of the dryer 120 can be determined by applying a step function as an input and then measuring the output of the dryer 120. Generally, this procedure is performed twice, once for increasing energy and once for decreasing energy.

Figure 5:
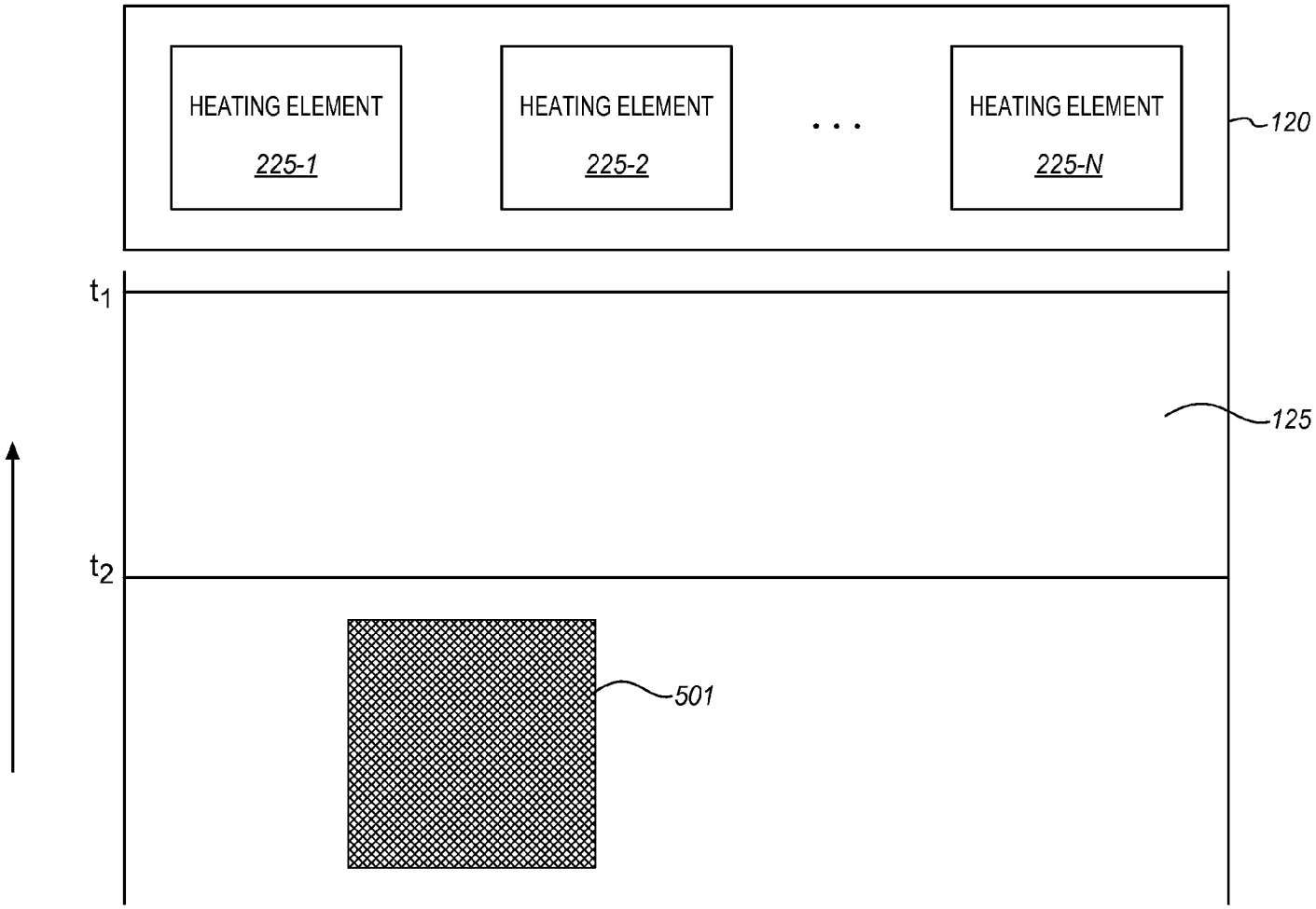
FIG. 5 is a filter output used in generating a heat control signal in an exemplary embodiment.

With this premise in mind, filters may be used to find the correct energy input signal for drying when the radiated area width of the subdivided energy source of the dryer 120 is wider than the ability to dry based on coverage. The first of these filters is an average filter 405 that initially filters the bitmap 110 to identify image regions in the bitmap 110 which may use more heat energy than other image regions. An example of such is illustrated in FIG. 5. The average filter 405 filters the bitmap 110 and identifies a image region 501 of ink which may require more heating by one or more the heating elements 225 than other image regions of ink on the print medium 125 as it approaches the dryer 120. In this instance, the image region 501 may require heating by the heating elements 225-1 and 225-2 while leaving the remaining heating elements off or at some predetermined minimum heat level.

Figure 6:
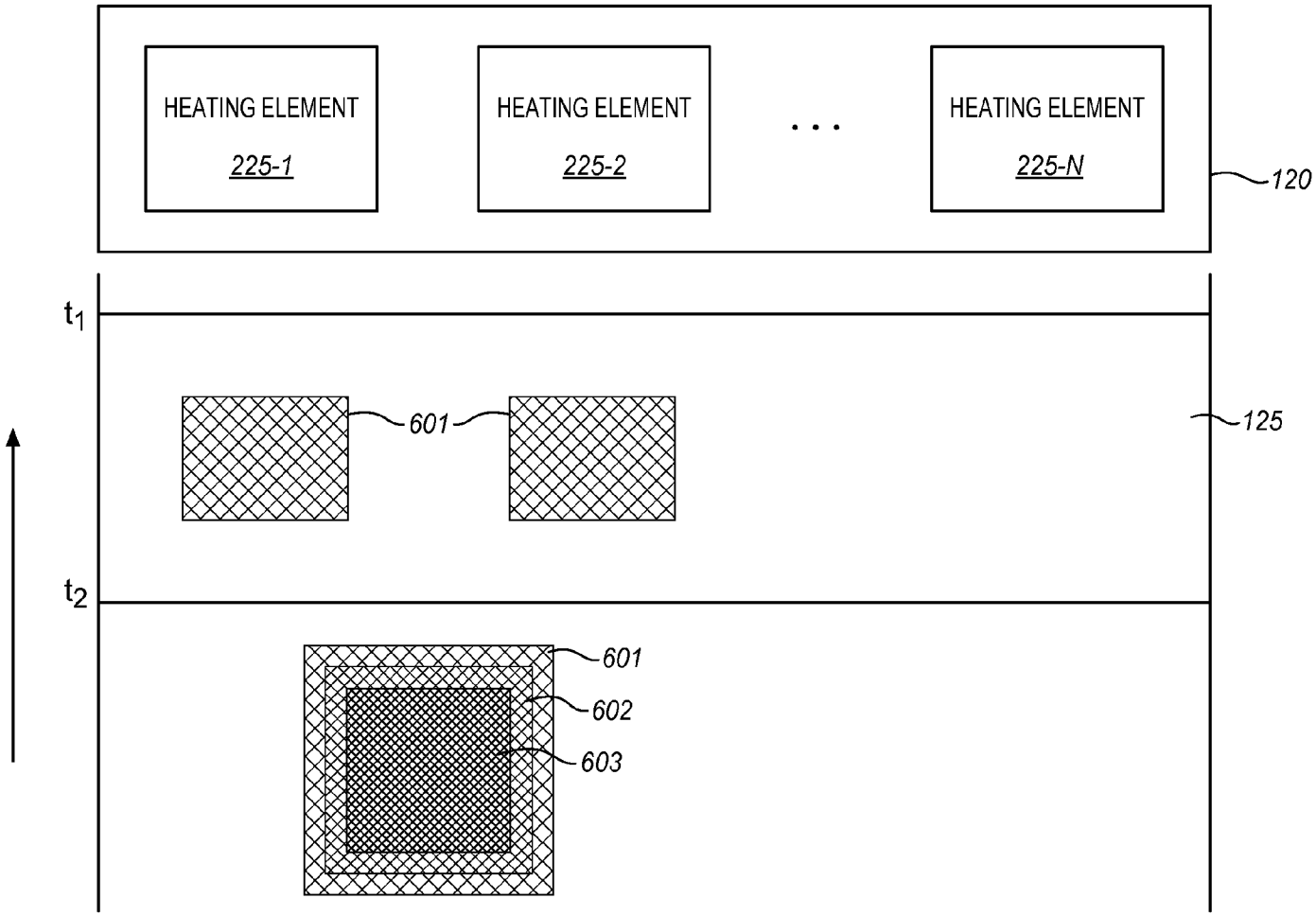
FIG. 6 is an exemplary filter process operable to find a maximum value of color values within a particular image region.

In this regard, the bitmap 110 may be collimated into rows for each of the heating elements 225 so as to find the maximum value of color values within a particular image region (e.g., CMYK, monochrome, etc.). This process is performed via the max filter 410, as illustrated in FIG. 6. The max filter 410 uses the identified image region 501 to identify color density values that may be used to compute requisite heat control signals for the heating elements 225-1-N. In this embodiment, the max filter 410 filters the image region 501 and forms two image regions having color density values 601 to generate appropriate heat control signals for the heating elements 225-1 and 225-2 at the time $t_1$ as these ink representations of the bitmap 110 come within range of the dryer 120. These heat control signals based on the color density values 601 initiate "ramping up" of the heating elements 225-1 and 225-2. The max filter 410 also extracts the maximum color density value 603 from the image region 501 to generate the time/spatial varying heat control signals for the heating elements 225-1 and 225-2 at the time $t_2$ (where the color density values 601, 602, 603 are increasing order of ink concentration). This row by row identification of maximum color values allows the controller 115 to apply heat control signals to each of the heating elements 225 as the print medium 125 with those color values represented in applied ink passes by the dryer 120.

For each of the heating elements 225, the output for each color plane in the bitmap 110 at each heating element 225 width is combined as a weighted sum via the weighted summer 415. If the drop sizes for the primary colors (e.g., C, M, Y, and K) are not the same, the weighting factors account for the drop size effect. For example, because the energy response bandwidth of the dryer 120 is finite, the target energy level may be slightly higher than necessary to ensure adequate drying over the expected range of the ink volume applied to the print medium 125. Additionally, the response of the dryer 120 for each of the primary inks is different. Because the spectral absorbtion response of each primary ink is generally fixed and because the spectral energy response of the dryer 120 is generally fixed, the composite input to the dryer 120 can be treated as a weighted sum of individual ink volumes, assuming superposition applies. Generally, the model of the dryer 120 assumes that the amount of energy absorbed into the substrate of the print medium 125 is small or at least approximately constant compared to the total energy required. If this assumption is false, the energy response to the dryer 120 using various print mediums can be measured and the inverse response calculated.

After the weighted sum is computed, the controller 115 passes the weighted sum through a lookup table 420 to convert the weighted sum to the required levels for the energy source inputs to the dryer 120 to produce the desired energy output from the heating elements 225. In other words, the controller 115 uses the lookup table 420 to identify a heat control signal for each heating element 225 based on a mapping of color density values to drying temperature. This control data is then serialized for each heating element 225 to expedite generation of heat control signals via the serializer 425. As part of the serialization process, a delay may be implemented if the dwell time of the dryer 120 is not adequate. In other words, if the heat control signal to a particular heating element 225 does not radiate enough heat for a particular amount of time, the duration and/or intensity of the heat control signal may be increased to the heating element 225.

After the heat control signal data is serialized, the controller 115 may digitally filter the serialized data via the digital filter 430 based on inverse characteristics of the energy response of the dryer 120. The digital filter 430 improves the overall response time of the heat control by removing noise from the serialized heat control data so as to smooth the input to the dryer 120. In other words, the smoother heat control signal allows the dryer 120 to respond as desired more quickly.

Once each heat control signal is filtered, the transfer of each signal may be delayed by some amount of time by a delay 435. For example, the speed of the print medium 125 passing by the dryer 120 may be determined and used as a control input to the dryer control module 440 as this generally affects when heat control signals are applied to the dryer 120. If the heat control signals are generated prior to the representation of the bitmap 110 via the ink applied to the print medium 125, those heat control signals may be buffered until the print medium 125 comes within range of the dryer 120.

Other inputs to the dryer control module 440 may include the actual width of the print medium 125 as well as the physical distances between heating elements 225. For example, all areas of the print medium should generally be exposed to the radiant heat of the dryer 120 at some minimal level so as to prevent damage to the print medium 125, such as cockling and/or paper steering (e.g., degraded paper path performance based on shrinkage towards one edge of the print medium 125). Accordingly, the dryer control module 440 may use information pertaining to the physical distances between heating elements as well as the width of the print medium 125 to establish a minimal radiant heat exposure to the print medium 125 from the heating elements 225. Other inputs to the dryer control module 440 may include safety signals that shut off the application of the heat control signals to the dryer 120. For example, should the print medium 125 jam somewhere within the printing process, heating of the print medium 125 becomes unnecessary and potentially dangerous as it may cause a fire. Accordingly, indication of a paper jam may be transferred to the dryer control module 440 to turn off the dryer 120. The dryer control module 440 may also be responsible for providing information indicative of the health of the dryer 120. For example, the dryer 120 may be configured with a sensor that feeds back to the dryer control module 440 that indicates whether the heating elements 225 are responding to the generated heat control signals. If the heating elements 225 are not responding as desired, one or more the heating elements 225 may require replacement.

Although shown and described with respect to the controller 115 digitally processing the bitmap 110 throughout the elements 405 through 440, the invention is not intended to be limited as such. For example, while the bitmap 110 is most likely a digital representation of the image, that digital representation may be converted to analog form at any point within the processing by the controller 115. Accordingly, if the bitmap 110 is converted to an analog form prior to processing by the controller 115, the average filter 405 would be implemented as an analog filter. Conversely, if the bitmap 110 is processed throughout the elements 405 through 435 in digital form, the dryer control module 440 may perform a digital to analog conversion of the heat control signals prior to application of the heat control signals to the dryer 120. The heating elements 225 may even be digitally controlled by the dryer control module 440.

The invention can take the form of an entirely hardware embodiment, an entirely software embodiment or an embodiment containing both hardware and software elements. In one embodiment, the invention is implemented in software, which includes but is not limited to firmware, resident software, microcode, etc.

Figure 7:
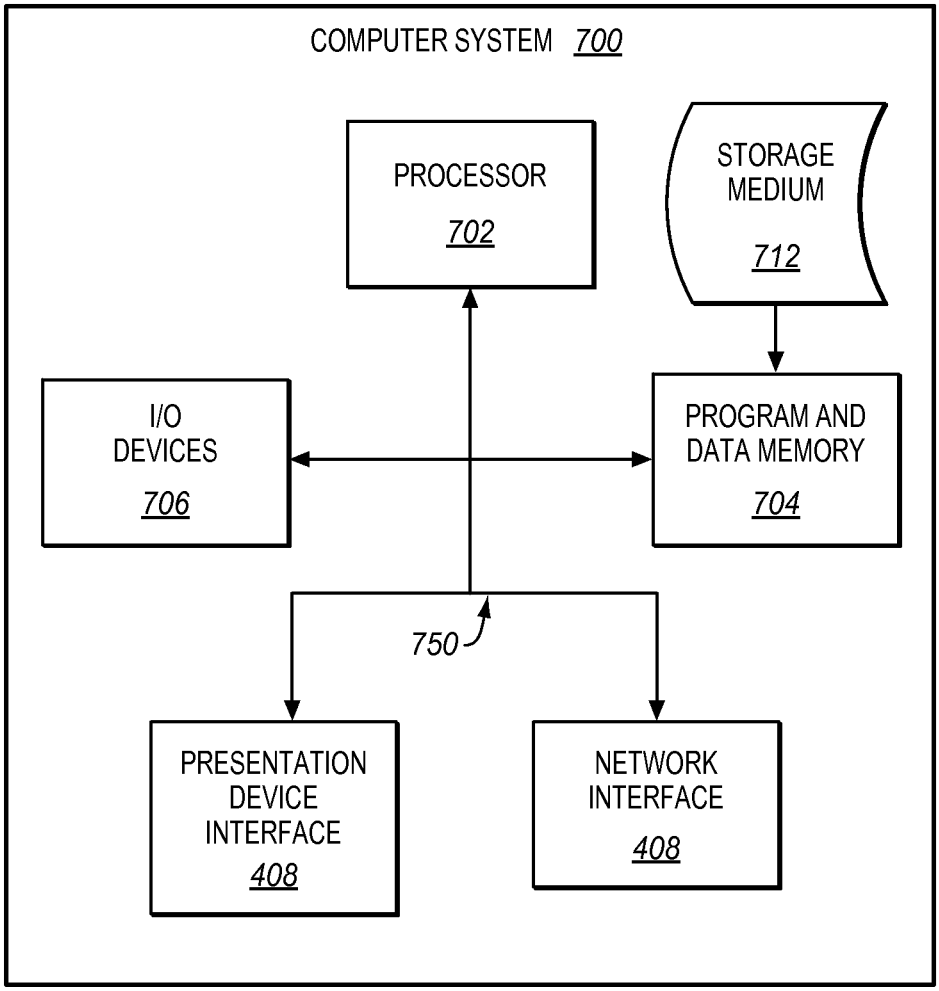
FIG. 7 is a block diagram of a computer system operable to execute computer readable medium embodying programmed instructions to perform desired functions in an exemplary embodiment.

FIG. 7 is a block diagram depicting a processing system 700 also operable to provide the above features by executing programmed instructions and accessing data stored on a computer readable storage medium 712. In this regard, embodiments of the invention can take the form of a computer program accessible via the computer-readable medium 712 providing program code for use by a computer or any other instruction execution system. For the purposes of this description, computer readable storage medium 712 can be anything that can contain, store, communicate, or transport the program for use by the computer.

The computer readable storage medium 712 can be an electronic, magnetic, optical, electromagnetic, infrared, or semiconductor device. Examples of computer readable storage medium 712 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

The processing system 700, being suitable for storing and/or executing the program code, includes at least one processor 702 coupled to memory elements 704 through a system bus 750. Memory elements 704 can include local memory employed during actual execution of the program code, bulk storage, and cache memories that provide temporary storage of at least some program code and/or data in order to reduce the number of times the code and/or data are retrieved from bulk storage during execution.

Input/output (I/O) 706 (including but not limited to keyboards, displays, pointing devices, etc) can be coupled to the processing system 700 either directly or through intervening I/O controllers. Network adapter interfaces 708 may also be coupled to the system to enable the processing system 700 to become coupled to other processing systems or storage devices through intervening private or public networks. Modems, cable modems, IBM Channel attachments, SCSI, Fibre Channel, and Ethernet cards are just a few of the currently available types of network or host interface adapters. Presentation device interface 710 may be coupled to the system to interface to one or more presentation devices, such as printing systems and displays for presentation of presentation data generated by processor 702.

Although specific embodiments are described herein, the scope of the invention is not limited to those specific embodiments. The scope of the invention is defined by the following claims and any equivalents thereof.

We claim:

1. A dryer system, comprising:

a dryer comprising a plurality of heating elements operable to dry ink applied to a print medium with infrared energy, wherein the heating elements are in fixed positions within the dryer and are adjacent to one another in a direction across a width of the print medium; and a controller operable to receive a plurality of bitmaps that correspond with an area of the print medium, wherein each of the plurality of bitmaps includes a grid of color values for a primary color;

the controller is further operable to apply a weight to each of the color values for an image region based on respective infrared absorption characteristics of each primary color, and to determine a level of heat that is directly proportional to a density of the weighted color values for the image region;

the controller is further operable to generate a heat control signal for one or more heating elements that correspond with the image region based on the level of heat, and to independently apply the heat control signal to the heating elements when the image region with applied ink is within proximity of the heating elements.

2. The system of claim 1, wherein:

the print medium is a continuous form print medium; and the controller is further operable to determine a speed at which the continuous form print medium is moving, and to delay transmission of the heat control signal based on the determined speed of the continuous form print medium until the ink applied to the continuous form print medium is within range of the dryer.

3. The system of claim 1, wherein:

the controller is configured as a feed-forward controller to provide variable heat control of the dryer based on continuous determinations of levels of heat for image regions of the print medium.

4. The system of claim 1, wherein:

the controller is further operable to apply a weight to each of the color values for the image region based on a relative drop size of each primary color.

5. The system of claim 1, wherein:

the image region is wider than a drying coverage area of an individual heater; and the controller is further operable to filter the plurality of bitmaps to form two image regions that correspond with the image region that is wider than the drying coverage area of an individual heater.

6. The system of claim 5, wherein:

the controller is further operable to compute heat control signals for two heating elements based on the two image regions to initiate heating up of the two heating elements before the image region corresponding to the print medium is passed underneath the two heating elements.

7. The system of claim 5, wherein:

the controller is further operable to filter the plurality of bitmaps via an inverse response of the dryer to provide heating from the dryer that is independent of ink volume changes.

8. The system of claim 1, wherein:

the controller is further operable to serialize image data of the bitmap to expedite generation of heat control signals used to independently apply the heat to each of the image regions of applied ink.

9. The system of claim 1, wherein:

the controller is further operable to independently apply heat to each of the image regions of applied ink based on absorption of the print medium.

10. The system of claim 1, wherein:

the controller is further operable to filter the bitmap through a probability distribution function to independently apply heat to each of the image regions of applied ink.

11. A non transitory computer readable medium comprising instructions that, when executed by a processor, direct the processor to control drying of ink on a print medium, the instructions further directing the processor to:

receive a plurality of bitmaps that correspond with an area of the print medium for ink to be applied, wherein each of the plurality of bitmaps includes a grid of color values for a primary color;

apply a weight to each of the color values for an image region based on respective infrared absorption characteristics of each primary color;

determine a level of heat that is directly proportional to a density of the weighted color values for the image region;

generate a heat control signal for one or more heating elements that correspond with the image region based on the level of heat; and independently apply the heat control signal to the heating elements when the image region with applied ink is within proximity of the heating elements.

12. The non transitory computer readable medium of claim 11, wherein the print medium is a continuous form print medium and the instructions further direct the processor to:

determine a speed at which the continuous form print medium is moving; and delay transmission of the heat control signal based on the determined speed of the continuous form print medium until the ink applied to the continuous form print medium is within range of the dryer.

13. The non transitory computer readable medium of claim 11, wherein the instructions that direct the processor to independently apply heat to each of the image regions of the applied ink further direct the processor to:

filter the bitmaps to identify average image regions in the bitmaps; and generate heat control signals based on the identified average image regions for application to the plurality of heating elements to provide variable heat control.

14. The non transitory computer readable medium of claim 11, the instructions further directing the processor to:

the controller is further operable to apply a weight to each of the color values for the image region based on a drop size of each primary color.

15. The non transitory computer readable medium of claim 11, the instructions further directing the processor to:

filter the plurality of bitmaps to form two image regions that correspond with the image region that is wider than the drying coverage area of an individual heater, wherein the image region is wider than a drying coverage area of an individual heater.

16. The non transitory computer readable medium of claim 15, the instructions further directing the processor to:

compute heat control signals for two heating elements based on the two image regions to initiate heating up of the two heating elements before the image region corresponding to the print medium is passed underneath the two heating elements.

17. The non transitory computer readable medium of claim 11, the instructions further directing the processor to:

filter the identified average image regions via an inverse response of a dryer to provide heating from the dryer that is independent of ink volume changes.

18. The non transitory computer readable medium of claim 11, wherein the instructions that direct the processor to filter the bitmaps to identify image regions in the bitmaps and further direct the processor to:

filter the bitmaps through a probability distribution function to provide variable heat from a dryer to the applied ink.

* * * * *